US010235843B2

(12) United States Patent
Ghia et al.

(10) Patent No.: US 10,235,843 B2
(45) Date of Patent: Mar. 19, 2019

(54) SMART BIN LOTTERY TICKET DISPENSER WITH RANDOM BIN SELECTION FOR BONUS PRIZE

(71) Applicant: Scientific Games International, Inc., Newark, DE (US)

(72) Inventors: Ajay J. Ghia, Cumming, GA (US); William F. Behm, Roswell, GA (US)

(73) Assignee: Scientific Games International, Inc., Newark, DE (US)

( * ) Notice: Subject to any disclaimer, the term of this patent is extended or adjusted under 35 U.S.C. 154(b) by 79 days.

(21) Appl. No.: 15/394,136

(22) Filed: Dec. 29, 2016

(65) Prior Publication Data

US 2018/0190065 A1 Jul. 5, 2018

(51) Int. Cl.
*G07F 17/32* (2006.01)

(52) U.S. Cl.
CPC ..... *G07F 17/329* (2013.01); *G07F 17/3225* (2013.01); *G07F 17/3253* (2013.01)

(58) Field of Classification Search
CPC . G07F 17/329; G07F 17/3225; G07F 17/3253
See application file for complete search history.

(56) References Cited

U.S. PATENT DOCUMENTS

| | | | | |
|---|---|---|---|---|
| 5,222,624 | A | 6/1993 | Burr | |
| 6,095,624 | A | 8/2000 | Wilbert | |
| 6,726,077 | B2 | 4/2004 | Roberts et al. | |
| 7,467,738 | B2 | 12/2008 | Woods et al. | |
| 8,192,268 | B1 | 6/2012 | Karpe | |
| 2001/0034263 | A1* | 10/2001 | Roberts | B26F 3/002 463/17 |
| 2016/0012680 | A1* | 1/2016 | Katz | G07F 17/3248 463/25 |

* cited by examiner

*Primary Examiner* — Werner G Garner
(74) *Attorney, Agent, or Firm* — Dority & Manning, P.A.

(57) ABSTRACT

A lottery ticket dispenser array includes a plurality of separate bins, with each bin defined by a housing having a defined first internal space for receipt of a supply of interconnected lottery tickets. Each bin has an electronic ticket drive mechanism a control system in communication with the drive mechanism to initiate a dispense sequence upon receipt of a ticket dispense command. The control system is furthered configured to generate a bin ID signal upon a lottery ticket being dispensed from the bin. A central lottery server receives the bin ID signals and is configured to randomly determine a select one of the bins within the dispenser array to associate with a bonus prize and, for each dispense sequence, to compare the received bin ID signal to the select bin to determine if the bin associated with the dispense cycle corresponds to the selected bonus bin.

12 Claims, 4 Drawing Sheets

SMART BIN LOTTERY TICKET DISPENSER WITH RANDOM BIN SELECTION FOR BONUS PRIZE

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

To date, the conventional lottery ticket dispensers have played a purely utilitarian function, namely to dispense tickets. It has not been conceived to incorporate the multi-bin structure of such arrays into a game that is in addition to the games embodied by the lottery tickets stored in the bins. A system and configuration wherein a lottery ticket dispenser array also formed an integral component of a separate game or potential source of an additional prize would be appealing to purchasers and drive sales to such an array as compared to conventional arrays.

The present invention provides a lottery ticket dispenser to satisfy the objective set forth above.

SUMMARY

Objects and advantages of the invention will be set forth in part in the following description, or may be obvious from the description, or may be learned through practice of the invention.

In accordance with aspects of the invention, a lottery ticket dispensing array is provided for dispensing instant or other preprinted lottery tickets at a retail establishment. The type of retail establishment may vary widely within the scope and spirit of the invention. For example, in certain embodiments, the retail establishments may be convenience stores, gas stations, pubs, and any other establishment that typically sells lottery tickets to the public. The present array has particular usefulness for much larger retail establishments, such as "big-box" retail stores that are part of a national or other geographic chain, wherein the sale of lottery ticket sales has generally not been implemented.

The lottery ticket dispenser array includes a plurality of separate bins, for example an array of 3×4 separate bins, wherein each bin is defined by a housing having a front side that faces a purchaser in operational use of the dispenser array, an opposite back side that faces the retail vendor or clerk. Each bin has a defined first internal space for receipt of a supply of interconnected lottery tickets therein, such as a fan-folded stack or roll of interconnected lottery tickets. Each bin may contain a supply of different scratch-off lottery ticket games, or two or more bins may contain a respective supply of tickets for the same game. The lottery tickets typically include a machine readable code printed thereon that includes unique ticket identification information, such as an alpha-numeric code, bar code, QR code, or the like.

Each bin in the array includes an electronic drive mechanism that, when activated, dispenses one or more lottery tickets from the bin (depending on the number of tickets requested by the patron) in a dispense cycle.

A control system is in communication with the drive mechanism in each bin to initiate a dispense sequence upon receipt of a ticket dispense command, for example from a terminal or POS (point-of-sale) register associated with the array. The control system may be a single system that is common to all of the bins within the array, or may be an individual control system configured with each bin. The control system is configured to generate a bin ID signal upon a lottery ticket being dispensed from the bin, wherein the bin ID signal identifies the array and the particular bin within the array.

A central lottery server is in communication with the control system or systems, wherein the bin ID signals are transmitted to the central lottery server for each dispense cycle. A plurality of the dispenser arrays located over a wide geographic region may be in communication with the central lottery server such that the bonus bin functionality is carried out simultaneously over numerous retail locations.

The central lottery server is configured to randomly determine a select one of the bins within the dispenser array to associate with a bonus prize and, for each dispense sequence, to compare the received bin ID signal to the selected bonus bin to determine if the bin associated with the dispense cycle corresponds to the selected bonus bin. Any manner of algorithm or random event generator may be associated with the central lottery server for this purpose.

A first electronic display (e.g., an LED display or electronic banner) is associated with each bin within the array and is visible to a purchaser that initiated the dispense sequence. The first electronic displays are in communication with the central lottery server (e.g., directly or via the control system associated with the bin) and generated a visual or audio indication if the bin associated with the dispense cycle is the selected bonus bin. In this manner, the purchaser in the retail establishment where the dispenser array is located is provided with a near-instantaneous indication of whether or not the bin associated with their lottery ticket selection is the selected bonus bin.

It should be appreciated that the prize award associated with the selected bonus bin can vary widely within the scope and spirit of the invention. For example, such prize may be free or discounted merchandise in the retail establishment, a ticket or coupon for play of a web-based game, credits in a reward or loyalty program, a cash prize, and so forth. The type of prize is not a limiting feature of the invention.

It may be desired in certain embodiments that the first electronic display is also configured to generate a visual or audio indication if the bin associated with the dispense cycle is not the selected bonus bin. In other words, the purchaser receives a positive indication via the display if the bin associated with their ticket purchase is the selected bonus bin or not.

As mentioned, each lottery ticket within the bins will typically include a code printed thereon that uniquely identifies the lottery ticket (e.g., by unique serial number or other information). Each bin may further comprise a scanner disposed within the housing to read the code as the lottery tickets are dispensed from the bin, wherein the bin ID signal also contains the unique ticket code. The central lottery server may perform any manner of accounting, verification, tracking, billing, or other function with unique ticket codes.

In certain embodiments, the central lottery server is configured to randomly determine the bonus bin for each dispense cycle associated with the dispenser array. This may be done upon receipt of the bin ID signal or, in an alternate embodiment, be done prior to each dispense cycle, stored, and retrieved by the central lottery server for each dispense cycle. In this embodiment, the selected bonus bin need not change or be randomly determined for each dispense sequence. For example, the random determination may be done according to a fixed time cycle and remain in effect until the next random bin determination.

It may be desired in certain embodiments for each bin within the array to include a second electronic display that is visible to the retail vendor that initiated the dispense sequence at the request of a purchaser, wherein this second electronic display is in communication with the central lottery server (e.g., directly or via the control system associated with the bin) and generates a visual or audio indication if the bin associated with the dispense cycle is the selected bonus bin, or gives a positive indication if the bin associated with the dispense cycle is not the selected bonus bin.

Depending on the type of prize associated with the selected bonus bin, it may be desired in certain embodiments to include a terminal at the POS location near the display, wherein this terminal is in communication with the central lottery server and is configured to print a receipt (e.g., a voucher) for the purchaser indicating a prize won if the bin associated with the dispense cycle is the selected bonus bin. For example, this receipt may include a voucher number that entitles the purchaser to a number of reward points in a reward program upon entering the number at a website. The voucher may be a coupon for free or discounted merchandise at the same or a different retail establishment, and so forth.

The present invention also encompasses a stand-alone lottery ticket bin as described herein.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
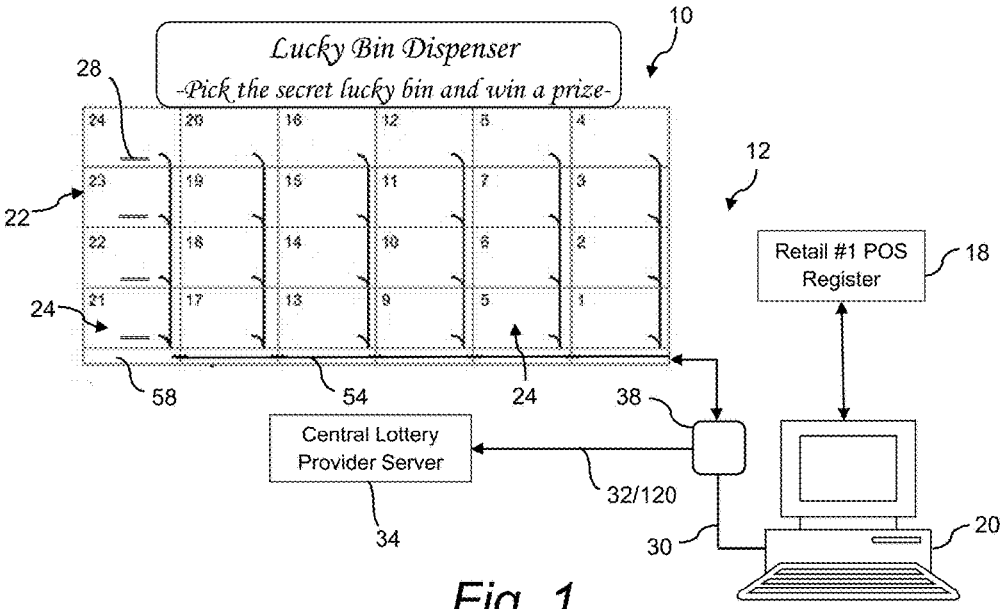
FIG. 1 is a block diagram of a lottery ticket dispenser in accordance with aspects of the present invention.

FIG. 1 depicts an embodiment of a system 10 and related methodology for dispensing lottery tickets 14 (FIGS. 3 and 4) at a retail establishment 12. As mentioned above, the type of retail establishment 12 may vary widely within the scope and spirit of the invention. A retail establishment or location 12, such as a retail store, convenience store, pub, restaurant, or the like, is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment 12 or lottery jurisdiction entities are not limiting factors of the invention. Although not limited to such, the present system 10 has particular usefulness for larger retail establishments, such as "big-box" retail stores that are part of a national or other geographic chain.

The retail establishment 12 includes one or more retail point-of-sale (POS) registers 18 wherein patrons of the establishment 12 purchase goods. Typically, a scanner is associated with the POS register 18 to scan a UPC code on the products, with the UPC code linked to a purchase price and identification of the products, as is well-known in the art.

In the embodiment of FIG. 1, a lottery ticket terminal 20 is configured in wired or wireless communication with the retail POS register 18 to accept a request for purchase of a particular lottery ticket 14 (FIG. 3) selected from a plurality of different lottery tickets made available to patrons for purchase. This request may be input directly to the terminal 20 or come via the POS register 18. The lottery tickets 14 may be, for example, conventional instant scratch-off lottery tickets. Various types of lottery ticket terminals are known in the art and suitable for configuration with a system 10 in accordance with the invention. For example, Scientific Games Corporation having a principal place of business in Alpharetta, Georgia, USA, offers Flair™ and Wave™ lottery ticket terminals that may be readily configured by those skilled in the art for a system as described herein.

A patron's request for a particular scratch-off lottery ticket may be input into the lottery ticket terminal 20 by a retail clerk or other employee of the retail establishment 12 by various means. For example, the terminal 20 may be configured with a scanner, wherein the clerk scans a "master" card having a code corresponding to the particular lottery ticket 14 requested by the patron. Thus, a master card or master code would be provided for each type of lottery ticket 14 offered by the establishment 12. In another embodiment, the terminal 20 may be configured with a touch-screen, keyboard, or other data input device, wherein the clerk enters or identifies the ticket 14 requested by the patron.

Still referring to the embodiment of FIG. 1, a "smart" lottery ticket dispenser array 22 is in wired or wireless communication with the terminal 20. This dispenser array includes one or a plurality of individual lottery ticket bins 24, with each bin 24 typically containing a different respective lottery ticket game. For example, one bin 24 may contain "Lucky 7" themed scratch-off lottery tickets 14, while an adjacent bin 24 may contain "Gold Rush" themed scratch-off lottery tickets 14, and so forth.

Each lottery ticket 14 in the different bins includes a machine readable code 15 (FIG. 6) printed on a front or back side thereof, such as an alpha-numeric code, bar code, QR code, or the like. The type of code may vary depending on the desired information content of the code, space on the ticket 14, and so forth. The use of such codes on lottery tickets 14 for various functions related to inventory, identification, verification, and security are well-known. In accordance with aspects of the invention, the lottery tickets in each bin 24 are generally loaded as a fan-folded stack or roll of sequentially numbered tickets, wherein the machine readable code on each lottery ticket 14 contains this number (as well as any manner of additional ticket information), for example in the form of a serial number embedded in the code.

Referring to the figures in general, each bin 24 in the dispenser array 22 includes an electronic drive mechanism 26 that, when activated, dispenses one or more lottery tickets 14 from the bin 24 (depending on the number of tickets requested by the patron). This drive mechanism 26 may include a motor that drives a friction roller, wherein the tickets 14 are engaged between the friction roller and an idler roller such that driven rotation of the friction roller causes the tickets 14 to be advanced through a dispensing slot 28 in a wall of the individual bin 24. The drive mechanism 26 may also include a sensor 106 that detects a leading and/or trailing edge of adjacent tickets 14 so as to control the run time of the drive mechanism 26 to ensure that perforations between the tickets 14 are presented at a tear bar or other cutting mechanism adjacent to the dispensing slot. For example, such a sensor may be an optical sensor that detects the perforation line between adjacent tickets. Alternately, the friction or idler roller may include an electrical or mechanical encoder that indirectly measures the length of a ticket passing between the rolls as a function or rotations of the roller. In another embodiment, a timing circuit may control the dispense cycle as a function of run time of the motor. It should be appreciated that the drive mechanism 26 may be variously configured to perform the functions of dispensing the requisite number of tickets 14 from the individual respective bin 24 within the scope and spirit of the invention.

In certain embodiments as depicted the illustrated embodiments, each bin 24 also includes a scanner 40 disposed so as to read the code on the lottery tickets 14 as they are dispensed from the bin 24. The scanner 40 may be any conventional barcode reader, such as linear scanner, laser scanner, LED image scanner, and so forth. The tickets 14 are loaded into the bins 24 such that the code printed on each ticket passes within the detection field of the scanner 40. An integral (or separate) reader is configured with the scanner 40 to decode the scanner signal.

Figure 2:
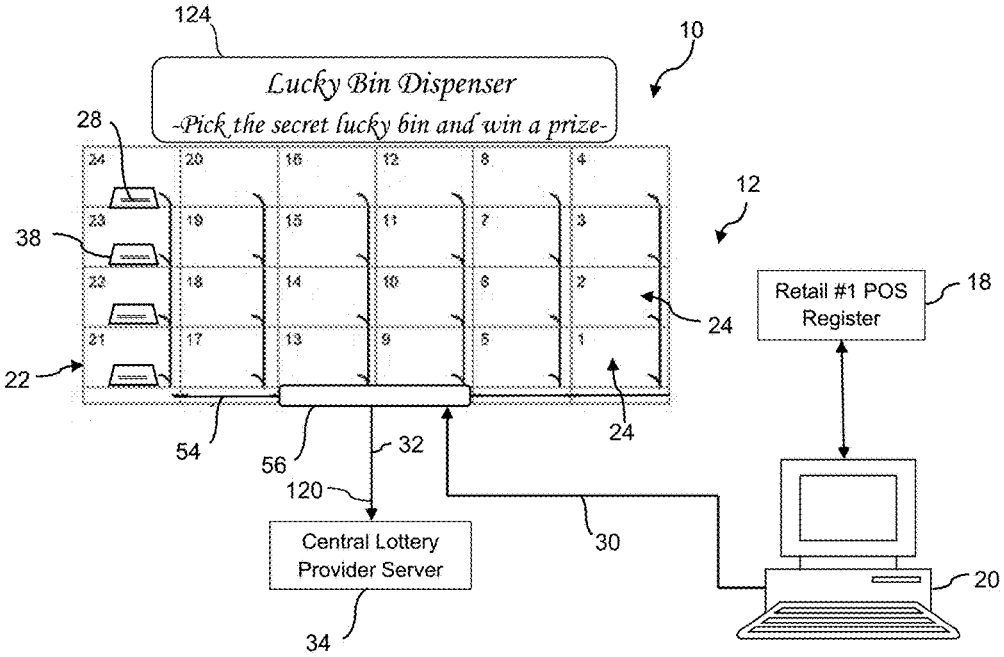
FIG. 2 is a block diagram of another embodiment of a lottery ticket dispenser in accordance with aspects of the present invention.

Referring to FIG. 2, any manner of electronic or printed display 124 may be associated with the array 22 to inform potential purchasers of the nature of the bonus bin system. This display 124 may inform the purchaser of the opportunity to win a bonus prize if the bin 24 associated with their ticket purchase corresponds to the randomly determined bonus bin, as well as the nature of the prize.

A control system 38 is in communication with the drive mechanism 26 in each bin 24 to initiate a dispense sequence upon receipt of a ticket dispense command, for example from the terminal 20 or POS (point-of-sale) register 18 associated with the array 22. The control system 38 may be a single system that is common to all of the bins within the array, as depicted in FIG. 1, or may be an individual control system configured with each bin, as depicted in FIG. 2. The control system 38 is configured to generate a bin ID signal 120 (FIG. 6) upon a lottery ticket being dispensed from the respective bin 24, wherein the bin ID signal 120 identifies the array 22 and the particular bin 24 within the array. This signal 120 may be generated, for example, when the control system 38 senses that a lottery ticket 14 has actually been dispensed from the bin 24 by any suitable detection process.

Figure 6:
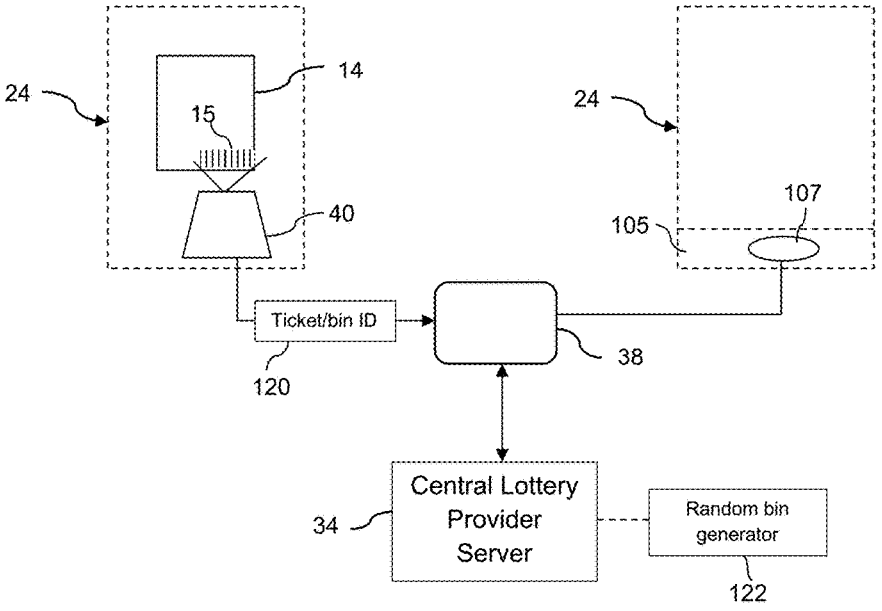
FIG. 6 is a diagram view of certain control aspects of the lottery ticket dispenser.

Referring to FIG. 6, the central lottery server 34 is in communication with the control system 38 or systems, wherein the bin ID signals 120 are transmitted to the central lottery server 34 for each dispense cycle. A plurality of the dispenser arrays 22 located over a wide geographic region may be in communication with the central lottery server 34 such that the bonus bin functionality is carried out simultaneously over numerous retail locations.

The central lottery server 38 is configured to randomly determine a select one of the bins 24 within the dispenser array 22 to associate with a bonus prize and, for each dispense sequence, to compare the received bin ID signal 120 to the selected bonus bin to determine if the bin associated with the dispense cycle corresponds to the selected bonus bin. Any manner of algorithm or random event generator 122 may be associated with the central lottery server 34 for this purpose.

The random determination of the selected bonus bin by the central lottery server 34 may be done for each dispense cycle associated with the dispenser array 22. This may be done upon receipt of the bin ID signal 120 or, in an alternate embodiment, be done prior to each dispense cycle, stored, and retrieved by the central lottery server 34 for each dispense cycle. In this embodiment, the selected bonus bin need not change or be randomly determined for each dispense sequence. For example, the random determination may be done according to a fixed time cycle and remain in effect until the next random bin determination.

Figure 4:
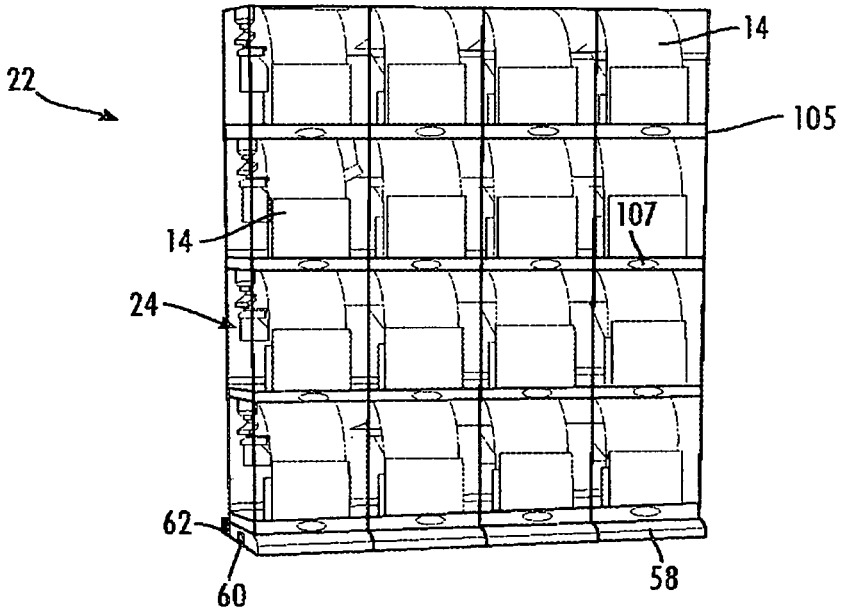
FIG. 4 is a front perspective view of the lottery ticket dispenser of FIG. 3.
Figure 5:
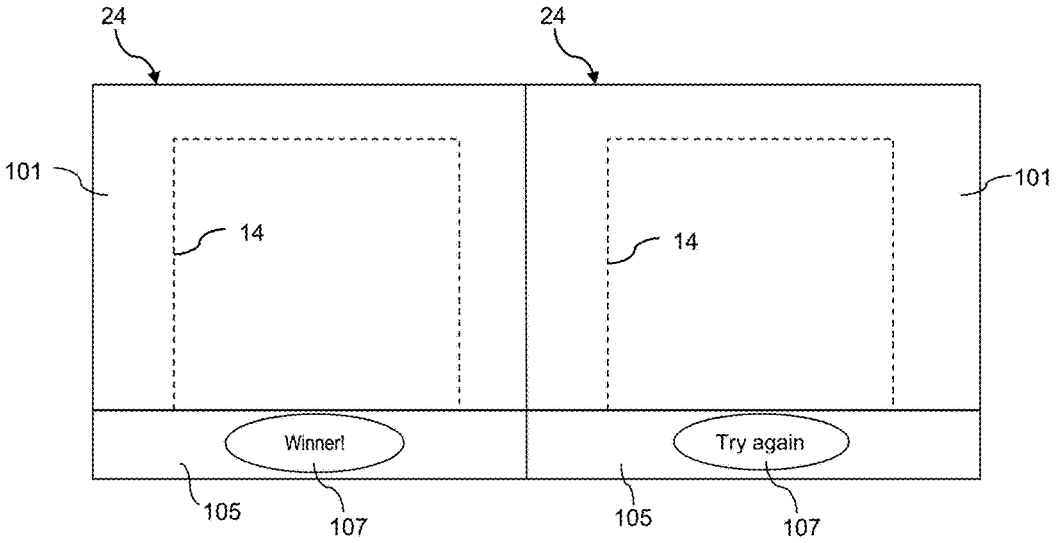
FIG. 5 is a diagram view of the front side of adjacent bins of a lottery ticket dispenser in accordance with aspects of the invention.

Referring to FIGS. 4 and 5 in general, in certain embodiments, each bin 24 in the array 22 includes a first electronic display 107 at the front side thereof, such as an LCD display that is located on the front side of the bin 24 so as to be clearly visible to a prospective purchaser. The first electronic displays 107 are in communication with the central lottery server 34 (e.g., directly or via the control system 38 associated with the bin 24) and generate a visual or audio indication if the bin 24 associated with the dispense cycle is the selected bonus bin. In this manner, the purchaser in the retail establishment where the dispenser array 22 is located is provided with a near-instantaneous indication of whether or not the bin 24 associated with their lottery ticket selection is the selected bonus bin.

It may be desired in certain embodiments that the first electronic display 107 is also configured to generate a visual or audio indication if the bin 24 associated with the dispense cycle is not the selected bonus bin. In other words, the purchaser receives a positive indication via the display 107 if the bin 24 associated with their ticket purchase is the selected bonus bin or not.

Figure 3:
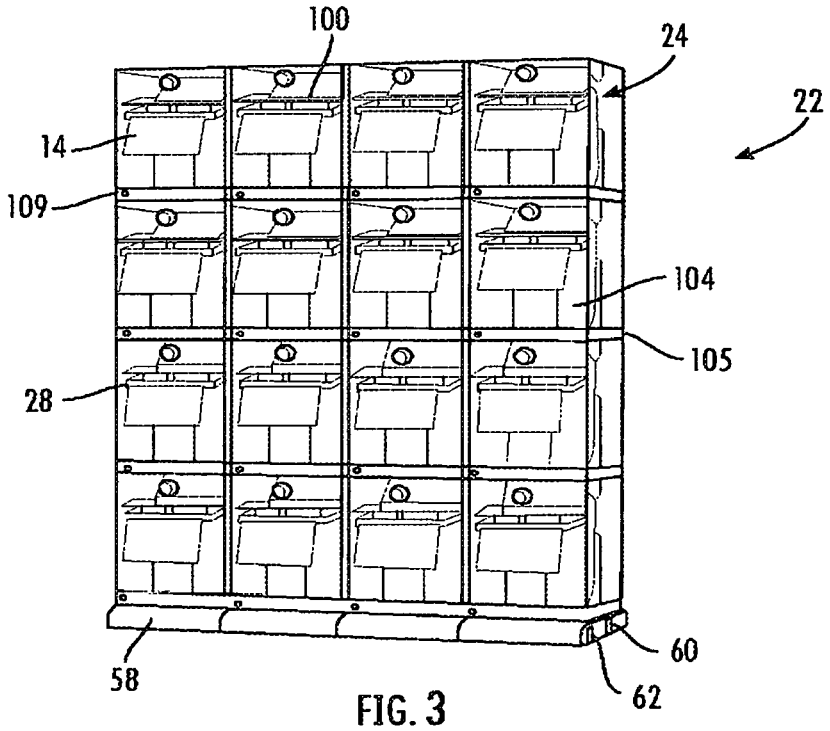
FIG. 3 is a back perspective view of an embodiment of a lottery ticket dispenser.

Referring to FIG. 3, in certain embodiments, each bin 24 may include a second electronic display 109 configured at the back side of the bin 24 so as to face the retail clerk or vendor in operation of the system 10. This second display 109 is also in communication with the control system 38 (or directly in communication with the central lottery server 34) and is configured to the vendor an indication of whether or not the bin 24 associated with a particular dispense cycle corresponds to the selected bonus bin. For example, this second display 109 may be a series of different colored LED's, wherein one color (e.g., green) indicates that the bin is the selected bonus bin, and a second color LED (e.g., red) indicates that the bin is not the selected bonus bin.

It should be appreciated that the prize award associated with the selected bonus bin can vary widely within the scope and spirit of the invention. For example, such prize may be free or discounted merchandise in the retail establishment, a ticket or coupon for play of a web-based game, credits in a reward or loyalty program, a cash prize, and so forth. The type of prize is not a limiting feature of the invention.

Depending on the type of prize associated with the selected bonus bin, it may be desired in certain embodiments that the terminal 20 (or a separate terminal) at the POS location near the array 22, which is in communication with the central lottery server 34, be configured to print a receipt (e.g., a voucher) for the purchaser indicating a prize won if the bin associated with the dispense cycle is the selected bonus bin. For example, this receipt may include a voucher number that entitles the purchaser to a number of reward points in a reward program upon entering the number at a website. The voucher may be a coupon for free or discounted merchandise at the same or a different retail establishment, and so forth.

For each bin 24, the control system 38 may be in communication with the scanner 40 and specifically configured for receipt of the scan signal from the scanner 40. The control system 38 can append or otherwise incorporate the unique ticket code 15 with the bin ID signal 120, wherein central lottery server 34 may perform any manner of accounting, verification, tracking, billing, or other function with unique ticket codes.

As mentioned, the control system 38 may be a central system that is common to (and in communication with) all of the bins 24 in the array for performing the functions discussed herein. This central control system 38 may be physically configured with the array 22 (e.g., within a base structure) or may be remote from the array 22.

In another embodiment depicted for example in FIG. 2, the control system 38 may be an individual system configured with each bin 24. For example, referring to FIGS. 7 and 8, each bin 24 may include a control board 100 having logic circuitry to control the various components within the bin 24, such as the leading edge sensor 106, drive motor timing circuit, electronic displays 107, 109, and so forth. Any manner of control or power components can be mounted on the board 100 for operation of the individual bins 24 as described herein. FIG. 2 depicts individual control systems 38 for each bin 24 in direct communication with the terminal 20 via a signal router 56 integrated with the dispenser array 22. This router 56 routes the purchase signal 30 from the lottery ticket terminal 20 to the correct bin 24.

Referring to FIGS. 1 and 2, the lottery ticket terminal 20 transmits a purchase signal 30 for dispensing a particular lottery ticket 14 that is routed to the respective bin 24 within the dispenser array 22 containing the requested lottery ticket. This purchase signal 30 may be sent to an individual control system 38 associated with the bin 24 (FIG. 2), or to a common control system 38 associated with all of the bins 24 (FIG. 1), to activate the drive mechanism 26 and dispense the requisite number of lottery tickets 14 from the bin 24.

In an alternate embodiment, the purchase signal 30 is generated by the POS register 18 and transmitted to the control system 38 after the POS register 18 receives a purchase code from the lottery ticket terminal 20 corresponding to the particular ticket requested by the patron.

As described above, as the tickets 14 are dispensed from the bin 24, the scanner 40 reads the code 15 printed on each ticket. Referring to FIGS. 1 and 2, a signal 32 corresponding to the scanned code (which may be incorporated with the bin ID signal 120) may be routed to the central lottery server 34 for each lottery ticket dispensed from the dispenser array 22 to enable certain actions relevant to the sale/dispensing of the individual tickets 14. For example, the central lottery server 34 may include a database of all tickets delivered to the respective retail establishments 12, and the near instantaneous identification of dispensed/sold lottery tickets 14 to the server 34 enables various desired functionalities. For example, the individual lottery tickets 14 may remain "inactive" in the lottery provider's system (and thus unable to be redeemed) until individually activated by the central lottery server 34 as they are dispensed and sold. Thus, fraudulently obtained tickets (e.g., stolen or otherwise illegally obtained) cannot be redeemed. This is contrary to a conventional practice of activating entire books ("packs") of tickets upon delivery to a retail establishment 12.

The present system 10 allows for enhanced accountability of lottery tickets 14 sold at a particular retail establishment 12 by logging each ticket as it is sold and dispensed. The number of tickets 14 sold during a work shift (or other time period) is easily determined by generating a report by the central server 34 of the tickets sold at any of the retail establishments during any defined time period. The number of tickets 14 sold at any of the retail establishments 12 can be readily reconciled with tickets delivered to the establishment. Likewise, the number of tickets 14 dispensed during a defined time can be readily and electronically reconciled with reported purchase transactions from the respective establishment 12, with discrepancies being immediately identified for further investigation.

Another particular advantage of the system 10 and associated method is that billing practices between the retail establishments 12 and lottery authority, the lottery service provider, or ticket manufacturer can be based on real-time sales of the lottery tickets 14. For example, the retail establishments 12 can be invoiced on a periodic basis (e.g., daily or weekly) for the actual number of tickets sold (dispensed) at each respective establishment based on the signals 32 routed to the central lottery server 34 instead of upon delivery, or other payment methodology typically in use today. These include but are not limited to consignment for a predetermined time period, or estimate of sales based on the number of winning tickets cashed from a pack of tickets being sold.

It should be appreciated that the terms "server" is used herein to encompass any configuration of computer hardware and software that is maintained by a lottery authority or game provider to carry out the functionalities of the present system 10 and associated method, as well as any manner of additional lottery functions known to those skilled in the art. It should be readily appreciated that the server 34 may include an integrated server, or any manner of periphery server or other hardware structure. The central lottery server 34 is typically remote from the retail establishments 12, and is in communication with the establishments 12 via a suitable secure communication network, which may include any manner of wide area network, wireless internet, or cloud computing. The server 34 may be a single networked computer, or a series of interconnected computers having access to the communications network via a gateway or other known networking system. Generally, the server 34 is configured to communicate with, manage, execute and control individual lottery terminal units 20 within the lottery jurisdiction. The server 34 may be a "front end" server provided by the lottery game provider that is interfaced with the existing draw/instant game system infrastructure one or more separate lottery authorities. The server 34 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 10.

The server 34 may be directly or indirectly connected through an I/O bus to any manner of peripheral devices such as storage devices, wireless adaptors, printers, and the like. In addition, a database (DB) may be communicatively connected to the server 34 and provide a data repository for the storage and correlation of information gathered from the individual dispenser arrays 22, such as the identity of each lottery ticket 14 dispensed from the array, the time of the dispense sequence, confirmation of ticket activation, and so forth.

It should be appreciated that embodiments of the methods and systems 10 disclosed herein may be executed by one or more suitable networked lottery gaming components and establishment components (e.g., POS register 18, back office server, and so forth) within a plurality of the establishments 12, as well as the remote central server 34. Such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

As mentioned above, aspects of the present system 10 and methods rely on the transmission of data over one or more communications networks. It should be appreciated that network communications can comprise sending and/or receiving information over one or more networks of various forms. For example, a network can comprise a dial-in, public switched telephone network (PSTN), a local area network (LAN), wide area network (WAN), the Internet, an intranet or other type of network. A network may comprise any number and/or combination of hard-wired, wireless, or other communication links.

The architecture of each bin 24 and the array 22 can vary within the scope of the invention. Referring to FIGS. 1 through 4, the dispenser array 22 includes a bottom row of bins 24 having interconnected base structures 58. For example, each base structure 58 may include a male power plug and male data plug along one side, and a female power port 60 and female data port 62 along the opposite side. The plugs and ports of adjacent base structures 58 interconnect to essentially define a data bus 54 (FIGS. 1 and 2) running the length of the base structures 58. An exposed power port 60 and data port 62 at one of the ends of the interconnected base structures is available for connection with a power cord and a data cord from the system control system 38 or lottery terminal 20.

Figure 7:
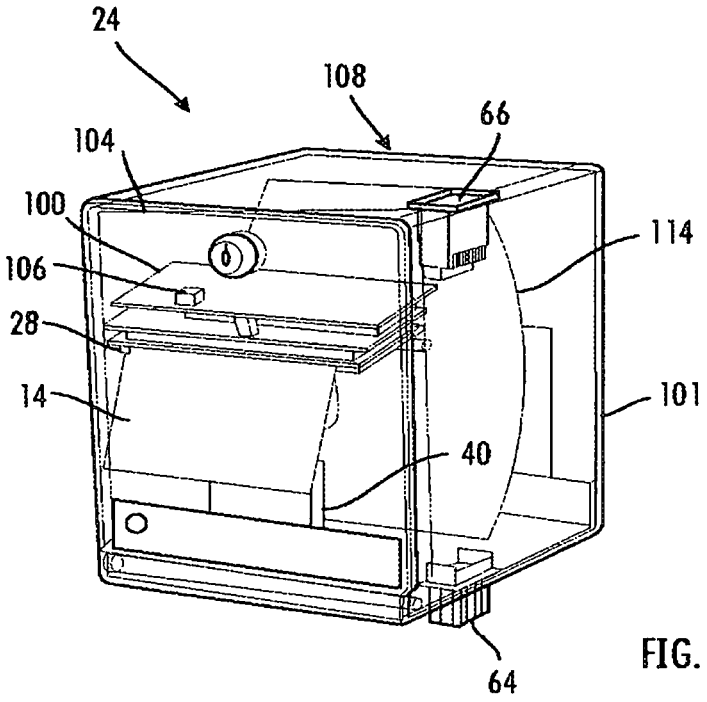
FIG. 7 is a front perspective view of a lottery ticket bin in accordance with the invention.
Figure 8:
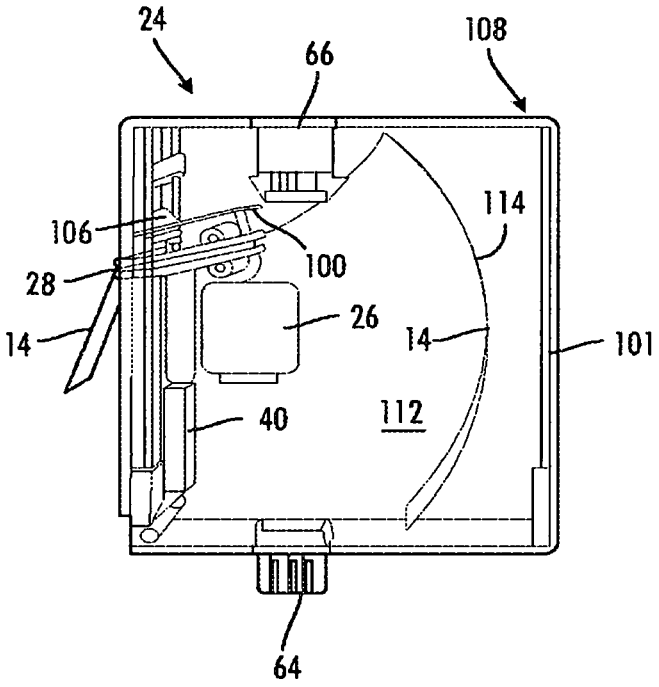
FIG. 8 is a side view of the bin embodiment of FIG. 7.

Referring to FIGS. 7 and 8 in particular, each of the individual bins 24 includes a multi-sided housing 108 defining an internal space 112 in which the stack or roll of lottery tickets 14 is stored. In the depicted embodiments, the housing 108 is a box-like member having top and bottom walls, side walls, a front wall 101, and a pivotal back wall or panel 104. The back panel 104 swings open to provide access into the housing 108 for loading the ticket stack. As shown in FIG. 4, each bin 24 may include a sample ticket 14 or other identifying insert attached to a front face of the bin 24 that faces the patrons so that the patron is aware of the exact tickets available for purchase. Each bin 24 includes a male power/data connector 64 on the top or bottom surface, and a corresponding female power/data connector 66 on the opposite surface, as seen in FIGS. 7 and 8. With this configuration, a plurality of the bins 24 can be vertically stacked and interconnected, as depicted in the various figures.

As depicted in FIGS. 3 through 8, in a certain embodiment, each bin 24 may include a bottom base portion 105 that incorporates the ports 64, 66 and is configured for interconnecting the bins, wherein the first electronic display 109 and second electronic display 107 are mounted in the bottom base portion 105. With this configuration, the pivotal door 104 at the back side of the housing 108 may be mounted above the bottom base portion 105. The scanner 40, electronic drive mechanism 26, and control board 100 may all be mounted on the pivotal door 104, as shown in FIGS. 7 and 8.

Referring to FIGS. 7 and 8, in an alternate embodiment, the first and second electronic displays 107, 109 may be incorporated in the front wall 101 of each bin, wherein the bottom base portion 105 is eliminated.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser array, comprising:

a plurality of separate bins, each bin defined by a housing having a front side that faces a purchaser in operational use of the lottery ticket dispenser array, an opposite back side, and an internal space for receipt of a supply of interconnected lottery tickets, wherein each lottery ticket contains a ticket code printed thereon that uniquely identifies the lottery ticket;

each bin having an electronic drive mechanism that dispenses the lottery tickets therefrom;

a control system in communication with the electronic drive mechanism to initiate a dispense sequence upon receipt of a ticket dispense command, the control system furthered configured to generate a bin ID signal upon each of the lottery tickets being dispensed from the bin;

a central lottery server, the control system in communication with the central lottery server and transmitting the bin ID signal to the central lottery server;

the central lottery server configured to randomly determine a bonus bin from the plurality of bins within the lottery ticket dispenser array to associate with a bonus prize, and, for the dispense sequence, to determine if the bin associated with the dispense sequence corresponds to the bonus bin; and a first electronic display associated with each bin within the lottery ticket dispenser array and visible to the purchaser that requested the dispense sequence, the first electronic display in communication with the central lottery server and comprising a first visual or audio indicator that informs the purchaser if the bin associated with the dispense sequence is the bonus bin.

2. The lottery ticket dispenser array as in claim 1, wherein the first electronic display further comprises a second visual or audio indicator that informs the purchaser if the bin associated with the dispense sequence is not the bonus bin.

3. The lottery ticket dispenser array as in claim 1, wherein the first electronic display is in communication with the central lottery server via the control system.

4. The lottery ticket dispenser array as in claim 1, each bin further comprising a scanner disposed to read the ticket code as the lottery tickets are dispensed from the bin, the bin ID signal also containing the ticket code.

5. The lottery ticket dispenser array as in claim 1, wherein the central lottery server is configured to randomly determine the bonus bin for each dispense sequence associated with the lottery ticket dispenser array.

6. The lottery ticket dispenser array as in claim 5, wherein the central lottery server randomly determines and stores identification of the bonus bin before each dispense sequence.

7. The lottery ticket dispenser array as in claim 5, wherein the central lottery server randomly determines the bonus bin at a time of each dispense sequence.

8. The lottery ticket dispenser array as in claim 1, further comprising a second electronic display associated with each bin within the lottery ticket dispenser array and visible to a vendor that initiated the dispense sequence at a request of the purchaser, the second electronic display in communication with the central lottery server and comprising a third visual or audio indicator that informs the vendor if the bin associated with the dispense sequence is the bonus bin.

9. The lottery ticket dispenser array as in claim 8, wherein the second electronic display further comprises a fourth visual or audio indicator that informs the vendor if the bin associated with the dispense cycle is not the bonus bin.

10. The lottery ticket dispenser array as in claim 1, further comprising a terminal in communication with the central lottery server, the terminal configured to print a receipt for the purchaser indicating a prize won if the bin associated with the dispense sequence is the bonus bin.

11. The lottery ticket dispenser array as in claim 1, wherein the control system is common to the plurality of bins in the lottery ticket dispenser array.

12. The lottery ticket dispenser array as in claim 1, wherein the control system is an individual control system for each bin.

* * * * *